US009974336B2

(12) United States Patent
Xue et al.

(10) Patent No.: US 9,974,336 B2
(45) Date of Patent: May 22, 2018

(54) POWER CONTROL CIRCUIT AND POWER CONTROL METHOD FOR ELECTRONIC CIGARETTE

(71) Applicant: uPI Semiconductor Corp., Hsinchu County (TW)

(72) Inventors: Ya-Ran Xue, Hsinchu County (TW); Heng-Li Lin, Hsinchu County (TW)

(73) Assignee: uPI Semiconductor Corp., Hsinchu County (TW)

( * ) Notice: Subject to any disclaimer, the term of this patent is extended or adjusted under 35 U.S.C. 154(b) by 207 days.

(21) Appl. No.: 14/945,449

(22) Filed: Nov. 19, 2015

(65) Prior Publication Data

US 2017/0049151 A1 Feb. 23, 2017

(30) Foreign Application Priority Data

Aug. 21, 2015 (TW) ..... 104127266 A

(51) Int. Cl.
*H05B 1/02* (2006.01)
*A24F 47/00* (2006.01)

(52) U.S. Cl.
CPC ..... *A24F 47/008* (2013.01); *H05B 1/0244* (2013.01)

(58) Field of Classification Search
CPC . A47F 47/008; H05B 1/0244; H05B 2213/04; H05B 1/0252; H05B 1/02
USPC ..... 219/483–486, 481, 497, 505; 131/328, 131/329, 271–273, 194
See application file for complete search history.

(56) References Cited

U.S. PATENT DOCUMENTS 4,870,238 A * 9/1989 Hodgetts ..... H05B 6/687 219/506
4,970,373 A * 11/1990 Lutz ..... F24H 9/2028 219/492
2015/0237916 A1* 8/2015 Farine ..... A24F 47/008 219/492
2017/0035115 A1* 2/2017 Monsees ..... H05B 1/0244
2017/0251728 A1* 9/2017 Peleg ..... A24F 47/008
2017/0280779 A1* 10/2017 Qiu ..... A24F 47/008

FOREIGN PATENT DOCUMENTS

CN 202819631 3/2013

* cited by examiner

*Primary Examiner* — Mark Paschall
(74) *Attorney, Agent, or Firm* — JCIPRNET

(57) ABSTRACT

A power control circuit and a power control method for an electronic cigarette are provided. The power control method includes the following steps: detecting a sensing temperature of a heating wire; when the sensing temperature is lower than a preset temperature, providing a first switch signal according to a ramp signal and an input signal, and adjusting an operation current of the electronic cigarette according to the first switch signal; and when the sensing temperature is higher than the preset temperature, providing a second switch signal, and adjusting the operation current of the electronic cigarette according to the second switch signal, wherein an on-time of the second switch signal is less than an on-time of the first switch signal. The invention controls the temperature of the electronic cigarette by adjusting the on-time so as to avoid overheating.

6 Claims, 6 Drawing Sheets

POWER CONTROL CIRCUIT AND POWER CONTROL METHOD FOR ELECTRONIC CIGARETTE

CROSS-REFERENCE TO RELATED APPLICATION

This application claims the priority benefit of Taiwan application serial no. 104127266, filed on Aug. 21, 2015. The entirety of the above-mentioned patent application is hereby incorporated by reference herein and made a part of this specification.

BACKGROUND OF THE INVENTION

Field of the Invention

The invention relates to technology of an electronic cigarette and more particularly relates to a power control circuit and a power control method for the electronic cigarette.

Description of Related Art

FIG. 1 is a circuit diagram of a conventional electronic cigarette. Please refer to FIG. 1. An electronic cigarette 10 includes an integrated circuit 110, a microcontroller MCU, an inductor L, and a heating wire 120. The integrated circuit 110 has pins LC1, LC2, VIN, EN, PGND, VOUT, and FB. The microcontroller MCU is coupled between the pin VOUT and the pin FB. The heating wire 120 is coupled between the pin VOUT and the pin GND. In the electronic cigarette 10, a load current that flows out of the pin VOUT is fixed. The microcontroller MCU is for controlling a feedback signal of the integrated circuit 110, so as to control an output voltage at the pin VOUT, thereby controlling the power of the electronic cigarette. Because the microcontroller MCU has the responsibility to control the output voltage, the electronic cigarette 10 usually requires other sensing circuits (not shown) to assist the microcontroller MCU in generating a pulse width modulation control signal 130.

FIG. 2 is a circuit diagram of another conventional electronic cigarette. Please refer to FIG. 2. An electronic cigarette 20 includes a pulse width modulation control circuit 210, switches 211-214, a heating wire 220, a capacitor 222, comparators 224-225, and a microcontroller MCU. The electronic cigarette adopts a buck-boost configuration. The microcontroller MCU controls a feedback path from an output voltage VOUT1 to the pulse width modulation control circuit 210, wherein a feedback circuit includes the comparators 224-225. The electronic cigarette 20 uses the microcontroller MCU to output a signal and transmits the signal to the pulse width modulation control circuit 210 via the comparators 224 and 225, so as to adjust the output voltage VOUT1.

The conventional electronic cigarettes 10 and 20 both use the microcontroller MCU, and the load current outputted by either of them is fixed, and they both control the output voltage to control the power. While the microcontroller MCU is used, usually other complicated circuits are required for performing detection. Therefore, the microcontroller MCU and the complicated circuits occupy a relatively large area with respect to the area of the entire circuit.

SUMMARY OF THE INVENTION

In view of the above, the invention provides a power control circuit and a power control method for an electronic cigarette.

The invention provides a power control circuit of an electronic cigarette, wherein the power control circuit is coupled to a heating wire. The power control circuit includes a switch, a control circuit, a temperature sensor, and a temperature control circuit. The switch is coupled to the heating wire. The control circuit is coupled to the switch and provides a first switch signal to control an operation of the switch. The temperature sensor detects a temperature of the heating wire to provide a temperature sensing signal, wherein the temperature sensing signal is related to a sensing temperature. The temperature control circuit is coupled to the temperature sensor and the control circuit and receives the temperature sensing signal. When the sensing temperature is higher than a first preset temperature, the temperature control circuit causes the control circuit to enter a temperature return mode from a normal operation mode, such that the control circuit controls the operation of the switch by a second switch signal, wherein an on-time of the second switch signal is less than an on-time of the first switch signal.

In an embodiment of the invention, the power control circuit further includes a signal generator providing a ramp signal and a square signal having the same cycle as the ramp signal. The control circuit provides the first switch signal when the control circuit is in the normal operation mode; and the control circuit performs a logic operation on the first switch signal and the square signal to generate the second switch signal when the control circuit is in the temperature return mode.

In an embodiment of the invention, the power control circuit further includes a first current source varying with temperature, a signal generator, a switch circuit, and a comparator. The first current source varying with temperature adjusts an input signal according to the sensing temperature. The signal generator provides a ramp signal. The switch circuit is coupled to the first current source and the temperature control circuit, wherein the switch circuit receives the input signal and provides a control signal according to an output result of the temperature control circuit. The comparator has a first input terminal coupled to an output tell final of the switch circuit and a second terminal receiving the ramp signal. When the control circuit is in the normal operation mode, the comparator outputs the first switch signal according to the control signal which is related to the input signal, and when the control circuit is in the temperature return mode, the comparator outputs the second switch signal according to the control signal which is related to an adjusted input signal.

In an embodiment of the invention, when the sensing temperature is higher than a second preset temperature, the temperature control circuit further sends a disable signal to disable the control circuit, wherein the second preset temperature is higher than the first preset temperature.

In an embodiment of the invention, when the sensing temperature is between the first preset temperature and the second preset temperature, the control circuit operates in the temperature return mode.

In an embodiment of the invention, after the control circuit is turned off, when the sensing temperature is lower than a third preset temperature, the temperature control circuit sends a restart signal to restart the control circuit. The third preset temperature is between the first preset temperature and the second preset temperature.

In an embodiment of the invention, the power control circuit further includes a power output stage coupled to the control circuit and the switch, wherein when the switch is turned on, the power output stage outputs an operation current to the switch, and when the switch is turned off, the power output stage stops outputting.

The invention further provides a power control method of an electronic cigarette, including the following steps: detecting a sensing temperature of a heating wire; providing a first switch signal according to a ramp signal and an input signal when the sensing temperature is lower than a preset temperature; adjusting an operation current of the electronic cigarette according to the first switch signal; and providing a second switch signal and adjusting the operation current of the electronic cigarette according to the second switch signal when the sensing temperature is higher than the preset temperature, wherein an on-time of the second switch signal is less than an on-time of the first switch signal.

In an embodiment of the invention, the power control method further includes: providing a square signal having the same cycle as the ramp signal. A logic operation is performed on the first switch signal and the square signal to generate the second switch signal.

In an embodiment of the invention, the step of providing the second switch signal includes: adjusting the input signal according to a temperature sensing signal and providing the second switch signal according to the adjusted input signal and the ramp signal.

Based on the above, the power control circuit and power control method for the electronic cigarette of the invention adjust the on-time of the control signal according to the temperature change in the temperature return mode to change the operation current, so as to prevent overheating. The adjustment of the on-time may be realized by using a digital or analog signal. Furthermore, the electronic cigarette of the invention does not require a microcontroller disposed in the path of the feedback circuit and thus has a simple structure.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
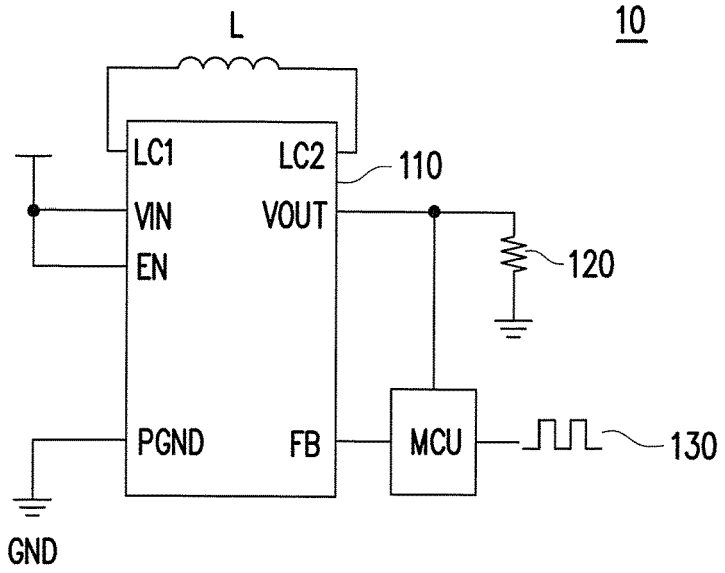
FIG. 1 (PRIOR ART)
FIG. 1 is a circuit diagram of a conventional electronic cigarette.
Figure 2:
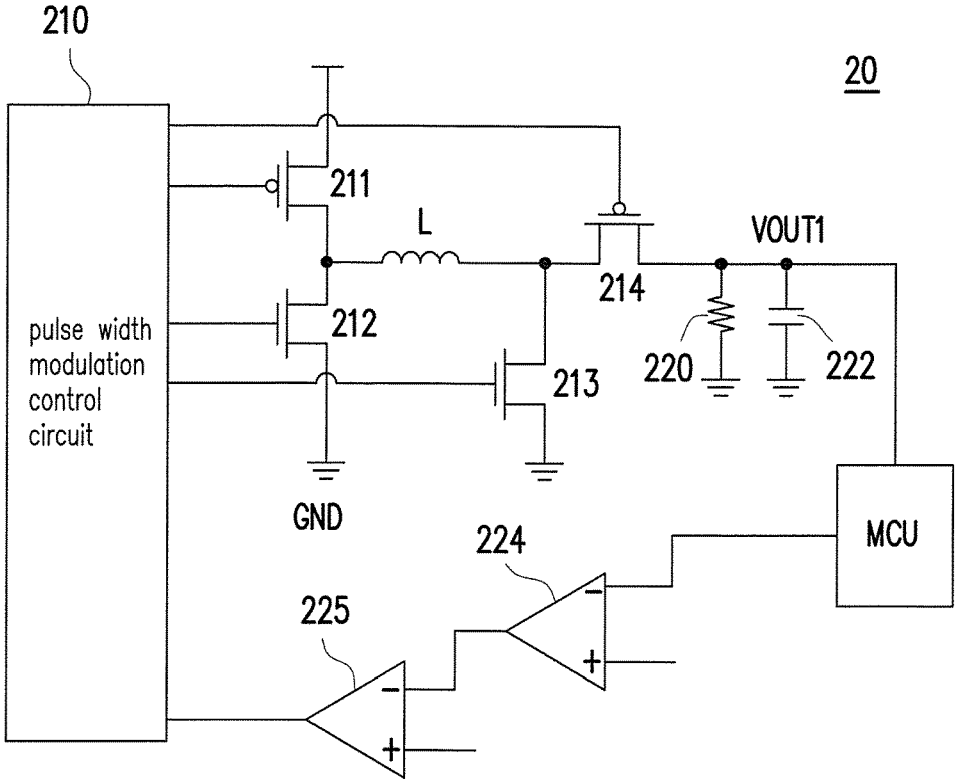
FIG. 2 (PRIOR ART)
FIG. 2 is a circuit diagram of another conventional electronic cigarette.

Exemplary embodiments of the invention are described in detail with reference to the figures. In addition, elements/components with identical or similar reference numerals are used to denote identical or similar parts in the figures and embodiments.

In the following embodiments, when an element is "connected" or "coupled" to another element, it may be directly connected or coupled to the another element, or other elements may be interposed therebetween. The term "circuit" may refer to at least one element or a plurality of elements, or elements that are actively and/or passively coupled together to provide a proper function. The term "signal" may denote at least one current, voltage, load, temperature, data, or other signals. It should be understood that the physical characteristic of the signal referred to throughout the specification and figures may be a voltage or a current.

It should also be understood that, although terms such as "first" and "second" are used to describe the elements in this specification, the elements should not be construed as limited by such terms. Such terms are merely used to distinguish one element from another. For example, the first switch may also be called the second switch, or likewise, the second switch may also be called the first switch without departing from the teaching of this disclosure.

Figure 3:
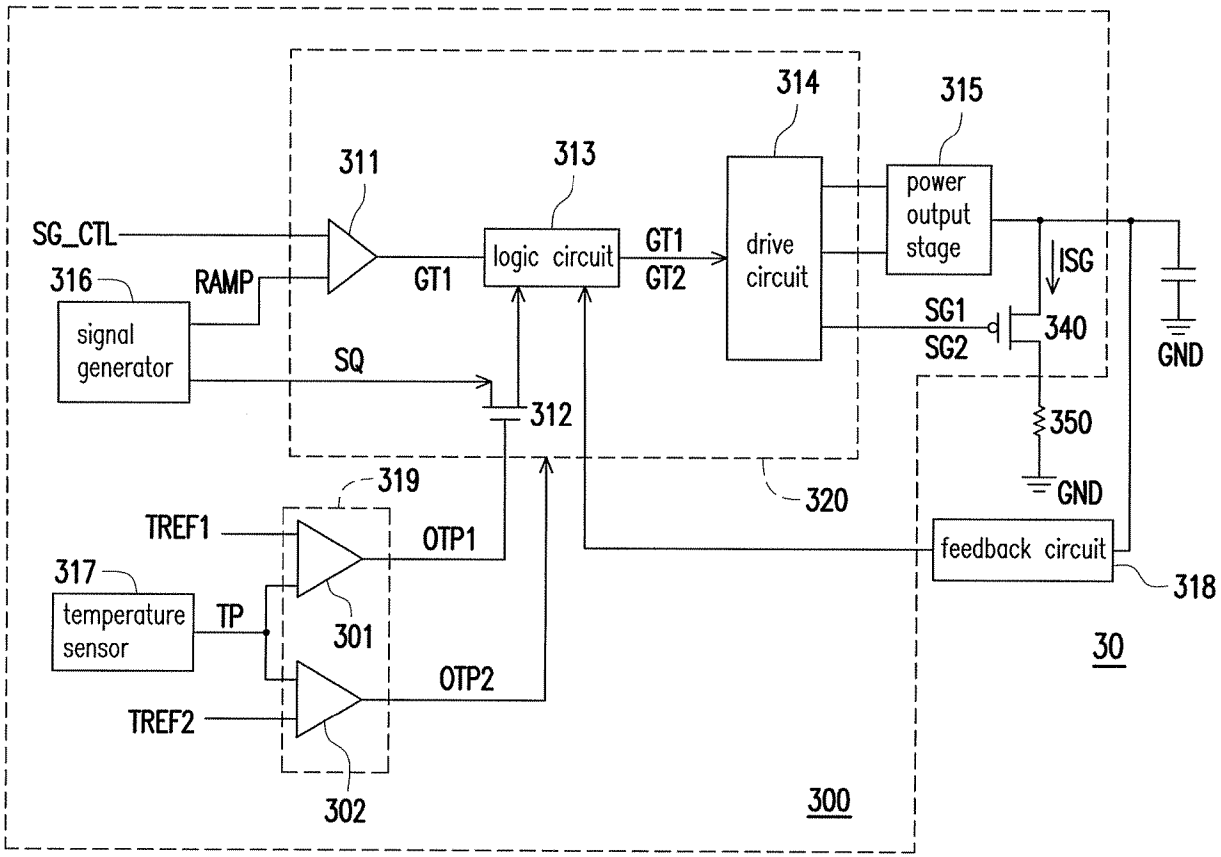
FIG. 3 is a circuit diagram of a power control circuit of an electronic cigarette according to an embodiment of the invention.

FIG. 3 is a circuit diagram of a power control circuit of an electronic cigarette according to an embodiment of the invention. Please refer to FIG. 3. A power control circuit 300 of an electronic cigarette 30 is coupled to a heating wire 350. The power control circuit 300 includes a switch 340, a control circuit 320, a temperature sensor 317, and a temperature control circuit 319. The switch 340 is coupled to the heating wire 350. The control circuit 320 is coupled to the switch 340. The temperature control circuit 319 is coupled to the temperature sensor 317 and the control circuit 320.

The control circuit 320 provides a first switch signal GT1 to control the operation of the switch 340. The temperature sensor 317 detects the temperature of the heating wire 350 to provide a temperature sensing signal TP, wherein the temperature sensing signal TP is related to a sensing temperature. The temperature control circuit 319 receives the temperature sensing signal TP. When the sensing temperature is higher than a first preset temperature, the temperature control circuit 319 provides a protection signal OTP1, such that the control circuit 320 enters a temperature return mode for overheating protection from a normal operation mode and that the control circuit 320 controls the operation of the switch 340 according to a second switch signal GT2, wherein the on-time of the second switch signal GT2 is less than the on-time of the first switch signal GT1.

Here, a first threshold signal TREF1 and a second threshold signal TREF2 represent switch conditions of the temperature return mode. For example, the working temperature of the electronic cigarette 30 in the nominal mode is 100 degrees Celsius. The electronic cigarette 30 enters the temperature return mode when the working temperature exceeds 120 degrees Celsius, and 120 degrees Celsius may be set as the switch condition of the nominal mode and the temperature return mode. In addition, the circuit may be burned and damaged when the temperature of the electronic cigarette 30 exceeds 160 degrees Celsius, and 160 degrees Celsius may be set as the switch condition of the temperature return mode and disablement. Therefore, the first threshold signal TREF1 and the second threshold signal TREF2 may be respectively defined as the voltage levels corresponding to 120 and 160 degrees Celsius. It should be noted that the values of the first threshold signal TREF1 and the second threshold signal TREF2 are not limited to those specified in this embodiment and may be decided according to the actual design requirements.

When the sensing temperature is higher than a second preset temperature (corresponding to the second threshold signal TREF2, e.g., 160 degrees Celsius), the temperature control circuit 319 further sends a disable signal OTP2 to disable the control circuit 320, wherein the second preset temperature is higher than the first preset temperature (e.g., 120 degrees Celsius). When the sensing temperature is between the first preset temperature and the second preset temperature, the control circuit 320 operates in the temperature return mode. After the control circuit 320 is turned off, if the sensing temperature is lower than a third preset temperature (e.g., 140 degrees Celsius), the temperature control circuit 319 sends a restart signal to restart the control circuit 320. The third preset temperature may be set to be between the first preset temperature and the second preset temperature.

An input signal SG_CTL may be a signal defined by the user. For example, the input signal SG_CTL may be defined according to an amount of smoke the user desires. Moreover, the input signal SG_CTL is a DC voltage level.

The power control circuit 300 further includes a signal generator 316. The signal generator 316 provides a ramp signal RAMP and a square signal SQ having the same cycle as the ramp signal RAMP. Here, the ramp signal RAMP is also called a triangular signal or a sawtooth signal. The control circuit 320 provides the first switch signal GT1 when the control circuit 320 is in the manual operation mode. The control circuit 320 performs a logic operation on the first switch signal GT1 and the square signal SQ to generate the second switch signal GT2 when the control circuit 320 is in the temperature return mode for overheating protection.

The power control circuit 300 further includes a power output stage 315. The power output stage 315 is coupled to the control circuit 320 and the switch 340. A feedback circuit 318 is coupled to the power output stage 315 and a logic circuit 313. When the switch 340 is turned on, the power output stage 315 outputs an operation current ISG to the switch 340; and when the switch 340 is turned off, the power output stage 315 stops outputting the operation current ISG.

Figure 4:
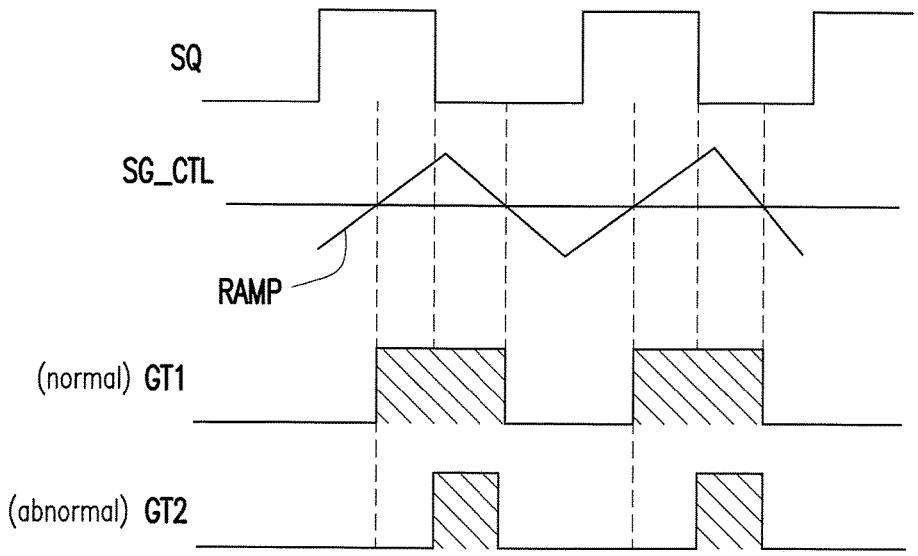
FIG. 4 is a waveform diagram showing various signals according to an embodiment of the invention.

FIG. 4 is a waveform diagram showing various signals according to an embodiment of the invention. Please refer to FIG. 3 and FIG. 4. Hereinafter, adjustment of the on-time may be realized by using a digital signal. The signal generator 316 provides the ramp signal RAMP and the square signal SQ, wherein the ramp signal RAMP and the square signal SQ have the same cycle. The ramp signal RAMP and the square signal SQ may both have the frequency of 25 KHz; however, it should be noted that the frequency is not limited thereto. The control circuit 320 may include a comparator 311, a switch 312, and a logic circuit 313. The comparator 311 compares the input signal SG_CTL and the ramp signal RAMP to provide the first switch signal GT1. A gate terminal of the switch 312 receives the protection signal OTP1. A first terminal of the switch 312 receives the square signal SQ. The logic circuit 313 is coupled to an output terminal of the comparator 311 and a second terminal of the switch 312.

The logic circuit 313 functions by the following principle: the logic circuit 313 directly outputs the first switch signal GT1 when not receiving the square signal SQ, and performs the logic operation on the first switch signal GT1 and the square signal SQ to generate the second switch signal GT2 when receiving the square signal SQ, such that the on-time of the second switch signal GT2 is less than the on-time of the first switch signal GT1.

Figure 5:
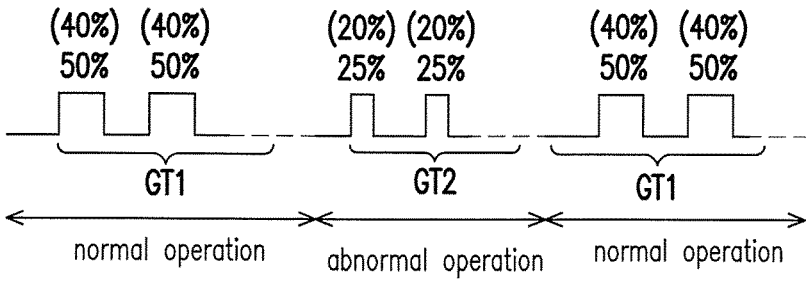
FIG. 5 is a diagram showing overheating protection according to an embodiment of the invention.

FIG. 5 is a diagram showing overheating protection according to an embodiment of the invention. Please refer to FIG. 3 to FIG. 5. The power control circuit 300 provides the first switch signal GT1 to a drive circuit 314 in the normal operation mode. However, if the temperature of the electronic cigarette 30 exceeds the range of normal operation (e.g. over 110 degrees Celsius), the second switch signal GT2 is provided to the drive circuit 314. The drive circuit 314 generates a first control signal SG1/a second control signal SG2 according to the first switch signal GT1/the second switch signal GT2 to control the switch 340. The first switch signal GT1 and the first control signal SG1 may have the same duty cycle (or on-time). Likewise, the second switch signal GT2 and the second control signal SG2 may have the same duty cycle.

When the power control circuit 300 is in the normal operation mode, the duty cycle of the first switch signal GT1 may be 50% (or 40%); and when the power control circuit 300 is in the temperature return mode (abnormal operation), the duty cycle of the second switch signal GT2 may be 25% (or 20%). Therefore, the on-time of the switch 340 may be reduced during the temperature return mode to reduce the operation current ISG flowing through the heating wire 350, thereby causing the temperature of the electronic cigarette 30 to drop. Basically, the effect of reducing the temperature may be achieved by making the on-time of the second switch signal GT2 less than the on-time of the first switch signal GT1. It should be noted that the ratio of the duty cycles of the first switch signal GT1 and the second switch signal GT2 is not limited to that specified in the above embodiments.

Figure 6:
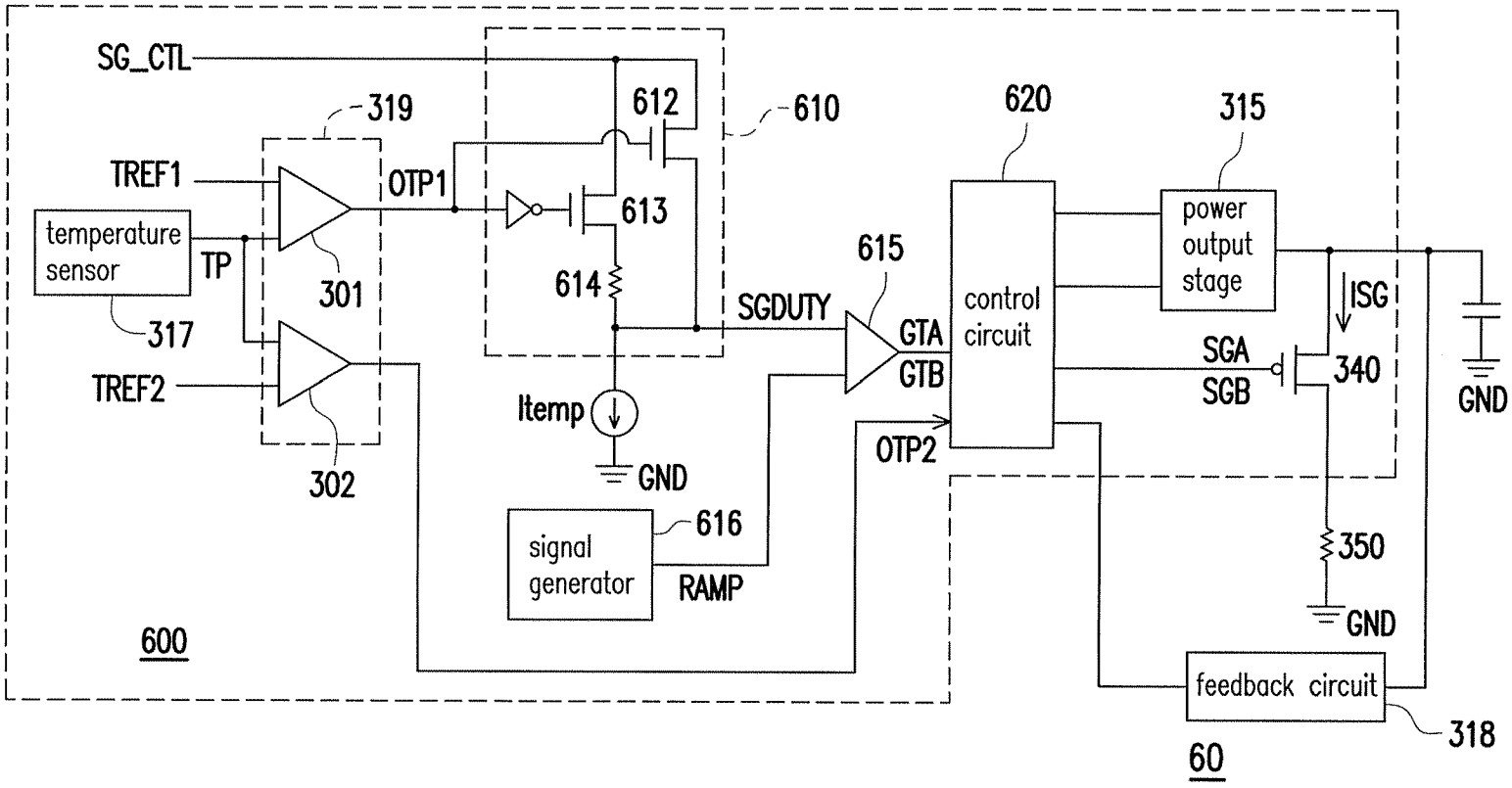
FIG. 6 is a circuit diagram of another power control circuit according to an embodiment of the invention.

FIG. 6 is a circuit diagram of another power control circuit according to an embodiment of the invention. Please refer to FIG. 6. Hereinafter, adjustment of the on-time may be realized by using an analog signal. A power control circuit 600 of an electronic cigarette 60 is coupled to a heating wire 350. The power control circuit 600 includes a switch 340, a control circuit 620, a temperature sensor 317, a feedback circuit 318, and a temperature control circuit 319. Working principles of the temperature sensor 317, the feedback circuit 318, and the temperature control circuit 319 are similar to those specified in the embodiment of FIG. 3 and thus are not repeated hereinafter.

The power control circuit 600 includes a current source Itemp that varies with temperature, a signal generator 616, a switch circuit 610, and a comparator 615. The current source Itemp is for adjusting the input signal SG_CTL according to the sensing temperature. The switch circuit 610 includes a switch 612 and a switch 613. A first terminal of the switch 612 and a first terminal of the switch 613 receive the input signal SG_CTL. A second terminal of the switch 612 is coupled to a first terminal of the current source Itemp and a second terminal of the current source Itemp is coupled to a ground terminal GND. A second terminal of the switch 613 is connected in series to the first terminal of the current source Itemp via a resistor 614. A gate terminal of the switch 612 receives the protection signal OTP1 and a gate terminal of the switch 613 receives an inverted signal of the protection signal OTP1.

The signal generator 616 is for providing the ramp signal RAMP. Here, the ramp signal RAMP is also called a triangular signal or a sawtooth signal. The switch circuit 610 is coupled to the current source Itemp and the temperature control circuit 319, wherein the switch circuit 610 receives the input signal SG_CTL and provides a control signal SGDUTY according to an output result of the temperature control circuit 319. A first input terminal of the comparator 615 is coupled to an output terminal of the switch circuit and a second terminal of the comparator 615 receives the ramp signal RAMP. When the control circuit 620 is in the normal operation mode, the comparator 615 outputs a first switch signal GTA according to the control signal SGDUTY which is related to the input signal SG_CTL, and when the control circuit 620 is in the temperature return mode, the comparator 615 outputs a second switch signal GTB according to the the control signal SGDUTY which is related to an adjusted input signal SG_CTL.

Figure 7:
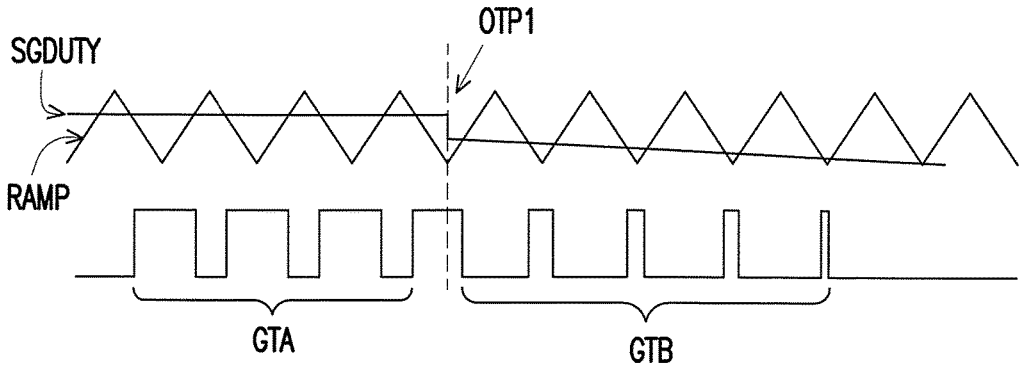
FIG. 7 is a waveform diagram showing various signals according to an embodiment of the invention.

FIG. 7 is a waveform diagram showing various signals according to an embodiment of the invention. With reference to FIG. 6 and FIG. 7, a common junction of the resistor 614, the switch 612, and the current source Itemp generates a control signal SGDUTY. The comparator 615 compares the control signal SGDUTY and the ramp signal RAMP. Here, Itemp denotes a symbol and a value. When the protection signal OTP1 is to disable, since the switch 612 is turned on, the control signal SGDUTY is equal to the input signal SG_CTL, and the comparator 615 outputs the first switch signal GTA. When the protection signal OTP1 is to enable, since the switch 613 is turned on, the control signal SGDUTY is equal to the input signal SG_CTL subtracting a voltage difference (voltage difference=hemp×R) between both terminals of the resistor 614 (the value thereof is represented by R). That is, the control signal SGDUTY is the adjusted input signal SG_CTL, and the comparator 615 outputs the second switch signal GTB. The control circuit enters the temperature return mode when overheating occurs, and the second switch signal GTB changes the on-time according to the temperature, and the on-time is getting smaller.

The power control circuit 600 provides the first switch signal GTA to the control circuit 620 in the normal operation mode. However, if the temperature of the electronic cigarette 60 exceeds the range of normal operation, the power control circuit 600 provides the second switch signal GTB whose duty cycle (or on-time) varies with temperature to the control circuit 620.

The control circuit 620 generates a first control signal SGA/a second control signal SGB according to the first switch signal GTA/the second switch signal GTB to control the switch 340. The first switch signal GTA and the first control signal SGA have the same duty cycle (or on-time). Likewise, the second switch signal GTB and the second control signal SGB have the same duty cycle. Therefore, the enable time of the gate terminal of the switch 340 may be reduced during the temperature return mode to reduce the operation current ISG flowing through the heating wire 350, thereby causing the temperature of the electronic cigarette 60 to drop. Basically, the effect of reducing the temperature may be achieved by making the on-time of the second switch signal GTB less than the on-time of the first switch signal GTA.

Figure 8:
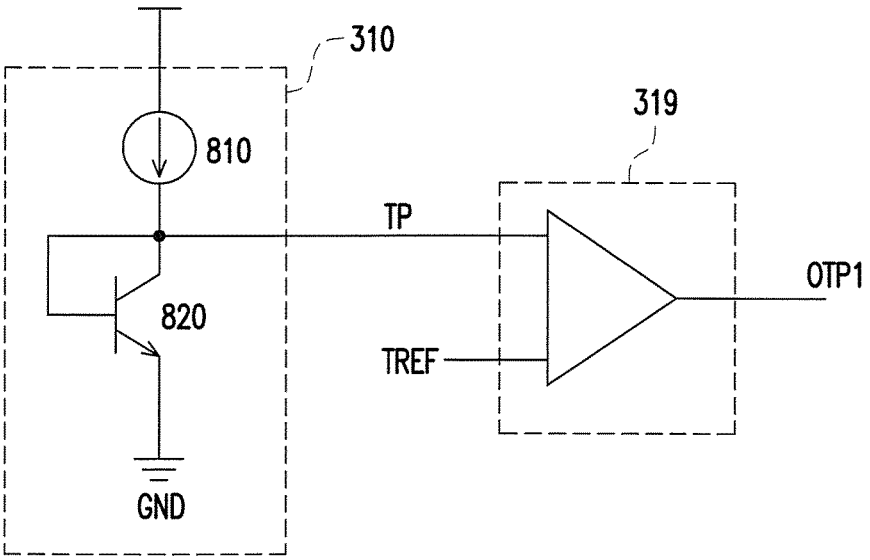
FIG. 8 is a circuit diagram of a temperature sensor according to an embodiment of the invention.

FIG. 8 is a circuit diagram of a temperature sensor according to an embodiment of the invention. A temperature sensor 307 includes a current source 810 and a bipolar junction type transistor 820. An emitter terminal of the bipolar junction type transistor (BJT) 820 is coupled to the ground terminal GND, and a collector terminal and a base terminal of the bipolar junction type transistor 820 are coupled to a terminal of the current source 810. By using the characteristics of the bipolar junction type transistor, a junction of the collector terminal and the base terminal of the BJT can generate different voltage levels according to the temperature change, which can be used to provide the temperature sensing signal TP.

Please refer to FIG. 6 and FIG. 8. This embodiment adopts the bipolar junction type transistor (BJT) 820. When the temperature rises, the value of the temperature sensing signal TP drops. That is, the temperature and the temperature sensing signal TP are inversely proportional to each other. Moreover, the first threshold signal TREF1 is set to 0.6V, for example. The temperature return mode is triggered when the temperature sensing signal TP is lower than 0.6V, so as to reduce the control signal SGDUTY. The second threshold signal TREF2 is set to 0.3V, for example. If the temperature return mode is unable to suppress the temperature rise of the heating wire 350, it indicates that the temperature sensing signal TP is lower than 0.3V. Once the temperature signal is lower than 0.3V, the disable signal OTP2 is sent to disable the control circuit 620, and the control circuit 620 is not enabled again until the temperature sensing signal TP returns to a safe value. The comparator 302 of this embodiment may have two values as the second threshold signal TREF2. For example, the preset value is 0.3V, and the second threshold value TREF 2 is adjusted to 0.4V after the control circuit 620 is disabled. That is, the second threshold signal TREF2 may be set to a fixed value between the preset value and TREF1, so as to prevent the control circuit 620 from being repeatedly disabled and enabled by the temperature sensing signal TP that oscillates around 0.3V.

Figure 9:
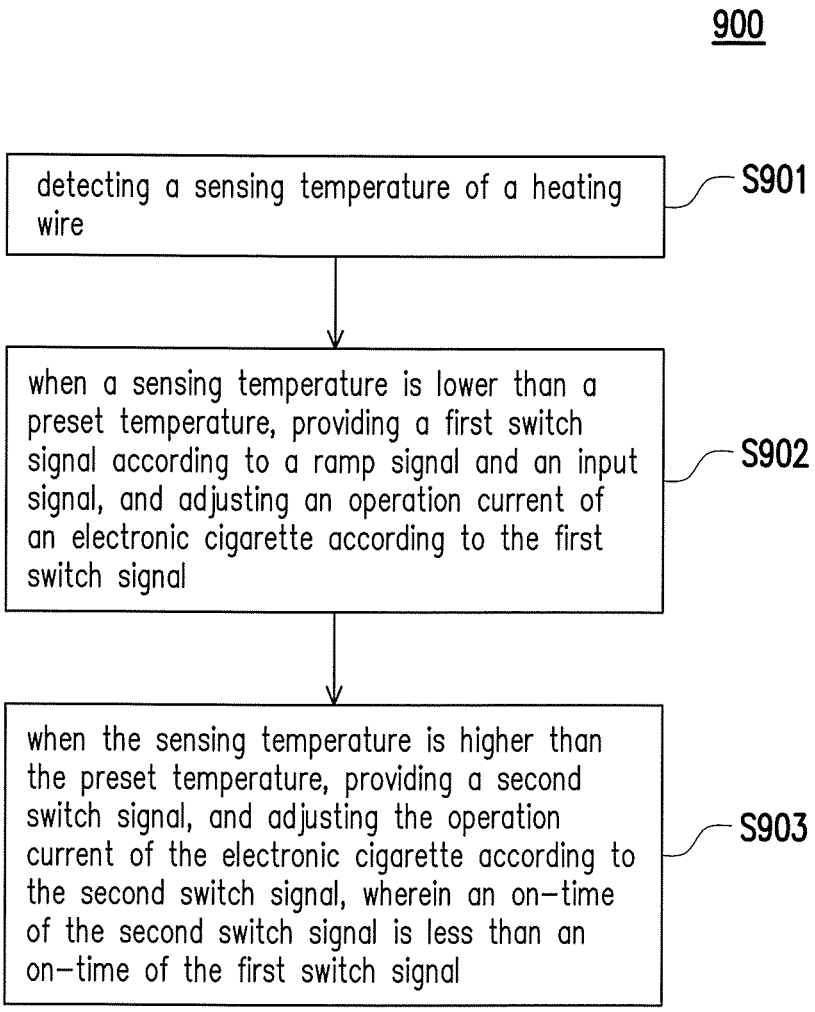
FIG. 9 is a flowchart showing a power control method of the electronic cigarette according to an embodiment of the invention.

Based on the above disclosed embodiments, a power control method for the electronic cigarette is concluded as follows. More specifically, FIG. 9 is a flowchart showing the power control method of the electronic cigarette according to an embodiment of the invention. Referring to FIG. 3, FIG. 6, and FIG. 9, a power control method 900 of this embodiment includes the following steps.

The sensing temperature of the heating wire 350 is detected, as shown in Step S901; then, when the sensing temperature is lower than the preset temperature, the first switch signal GT1 (or GTA) is provided according to the ramp signal RAMP and the input signal SG_CTL, and the operation current ISG of the electronic cigarette 30 is adjusted according to the first switch signal GT1 (or GTA), as shown in Step S902; and when the sensing temperature is higher than the preset temperature, the second switch signal GT2 (or GTB) is provided, and the operation current ISG of the electronic cigarette 30 is adjusted according to the second switch signal GT2 (or GTB), as shown in Step S903, wherein the on-time of the second switch signal GT2 (or GTB) is less than the on-time of the first switch signal GT1 (GTA).

The power control method 900 further includes: providing the square signal SQ having the same cycle as the ramp signal RAMP. In addition, the Step S903 of providing the second switch signal GT2 (or GTB) includes: performing a logic operation on the first switch signal GT1 and the square signal SQ to generate the second switch signal GT2.

In an embodiment, the Step S903 of providing the second switch signal GT2 (or GTB) includes: adjusting the input signal SG_CTL according to the temperature sensing signal TP and providing the second switch signal GTB according to the adjusted input signal SG_CTL and the ramp signal RAMP.

Based on the above, the power control circuit and power control method for the electronic cigarette of the invention adjust the on-time of the control signal according to the temperature change in the temperature return mode to change the operation current, so as to prevent overheating. The adjustment of the on-time may be realized by using a digital or analog signal. Furthermore, the electronic cigarette of the invention does not require a microcontroller disposed in the path of the feedback circuit and thus has a simple structure.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A power control circuit of an electronic cigarette, the power control circuit being coupled to a heating wire and comprising:

a switch coupled to the heating wire;

a control circuit coupled to the switch and providing a first switch signal to control an operation of the switch;

a temperature sensor detecting a temperature of the heating wire to provide a temperature sensing signal, wherein the temperature sensing signal is related to a sensing temperature; and a temperature control circuit coupled to the temperature sensor and the control circuit and receiving the temperature sensing signal, wherein when the sensing temperature is higher than a first preset temperature, the temperature control circuit causes the control circuit to enter a temperature return mode from a normal operation mode, such that the control circuit controls the operation of the switch by a second switch signal, wherein an on-time of the second switch signal is less than an on-time of the first switch signal, wherein when the sensing temperature is higher than a second preset temperature, the temperature control circuit further sends a disable signal to disable the control circuit so as to prevent the control circuit from being burned and damaged, wherein the second preset temperature is higher than the first preset temperature.

2. The power control circuit according to claim 1, further comprising:

a signal generator providing a ramp signal and a square signal having the same cycle as the ramp signal, wherein the control circuit provides the first switch signal when the control circuit is in the normal operation mode; and the control circuit performs a logic operation on the first switch signal and the square signal to generate the second switch signal when the control circuit is in the temperature return mode.

3. The power control circuit according to claim 1, further comprising:

a first current source varying with temperature for adjusting an input signal according to the sensing temperature;

a signal generator providing a ramp signal;

a switch circuit coupled to the first current source and the temperature control circuit, wherein the switch circuit receives the input signal and provides a control signal according to an output result of the temperature control circuit; and a comparator comprising a first input terminal coupled to an output terminal of the switch circuit and a second terminal receiving the ramp signal, wherein when the control circuit is in the normal operation mode, the comparator outputs the first switch signal according to the control signal which is related to the input signal, and when the control circuit is in the temperature return mode, the comparator outputs the second switch signal according to the control signal which is related to an adjusted input signal.

4. The power control circuit according to claim 1, wherein when the sensing temperature is between the first preset temperature and the second preset temperature, the control circuit operates in the temperature return mode.

5. The power control circuit according to claim 1, wherein after the control circuit is turned off, when the sensing temperature is lower than a third preset temperature, the temperature control circuit sends a restart signal to restart the control circuit, wherein the third preset temperature is between the first preset temperature and the second preset temperature.

6. The power control circuit according to claim 1, further comprising:

a power output stage coupled to the control circuit and the switch, wherein when the switch is turned on, the power output stage outputs an operation current to the switch, and when the switch is turned off, the power output stage stops outputting.

* * * * *